United States Patent [19]

Johansson

[11] Patent Number: 4,679,340

[45] Date of Patent: Jul. 14, 1987

[54] CLOTHING DATA MARKER

[76] Inventor: Gert A. Johansson, P.O. Box 158, 443 01 Lerum, Sweden

[21] Appl. No.: 709,733

[22] Filed: Mar. 8, 1985

[51] Int. Cl.[4] ..... G09F 3/00

[52] U.S. Cl. ..... 40/322; 40/316; 40/2 R; 223/85

[58] Field of Search ..... 40/322, 316, 23 R, 21 R, 40/2 R, 2; 223/85

[56] References Cited

U.S. PATENT DOCUMENTS

| | | | |
|---|---|---|---|
| 1,575,775 | 3/1926 | Lesser | 40/322 |
| 3,067,534 | 12/1962 | Paxton | 40/23 R |
| 3,270,872 | 7/1966 | Paxton | 40/2 R |
| 3,706,147 | 12/1972 | Glaser | 40/2 R |
| 3,898,754 | 8/1975 | Johansson | 40/322 |
| 3,977,104 | 8/1976 | Stupar | 40/316 |
| 4,017,990 | 4/1977 | Garrison | 40/322 |
| 4,045,899 | 9/1977 | Richardson | 40/322 |
| 4,123,864 | 11/1978 | Baits et al. | 40/322 |
| 4,268,786 | 5/1981 | Piana | 40/316 |

FOREIGN PATENT DOCUMENTS

| | | | |
|---|---|---|---|
| 151487 | 5/1953 | Australia | 40/2 R |
| 655749 | 1/1938 | Fed. Rep. of Germany | 40/316 |
| 2655958 | 6/1978 | Fed. Rep. of Germany | 40/316 |
| 3041747 | 5/1982 | Fed. Rep. of Germany | 40/322 |
| 83/04122 | 11/1983 | PCT Int'l Appl. | 40/322 |

*Primary Examiner*—Gene Mancene
*Assistant Examiner*—J. Hakomaki
*Attorney, Agent, or Firm*—Sughrue, Mion, Zinn, Macpeak and Seas

[57] ABSTRACT

A marker particularly adapted to fit onto the hook of a clothes hanger and bearing alpha numeric information on its periphery takes the form of a cylindrical ring defining a central traversing hole receiving the clothes hanger hook whose outer periphery bears the alpha numeric information. A radial slot extending over the entire longitudinal extend of the ring whose width is in excess of the width of the clothes hanger hook permits radial entry of the clothes hanger hook. A pair of barbs arranged respectively to the sides of the slots with pointed ends directed radially inwards towards the center of the marker with their pointed wedged ends confronting each other, permits the clothes hanger hook to be pushed through the slot by deflecting the barbs laterally. Locating lugs extending from the inner surface of the cylindrical ring wall towards the center of the marker unit center the ring relative to the hook. At least the barbs are formed of resilient material.

5 Claims, 3 Drawing Figures

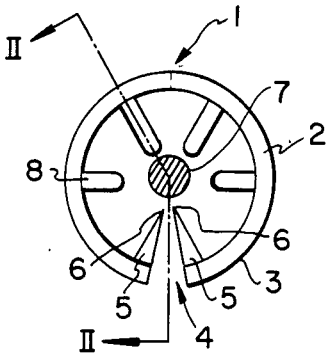
FIG. 1
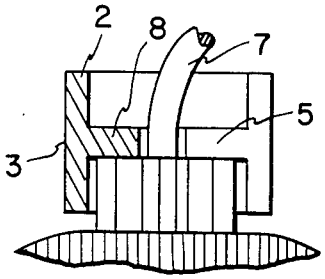
FIG. 2
FIG. 3
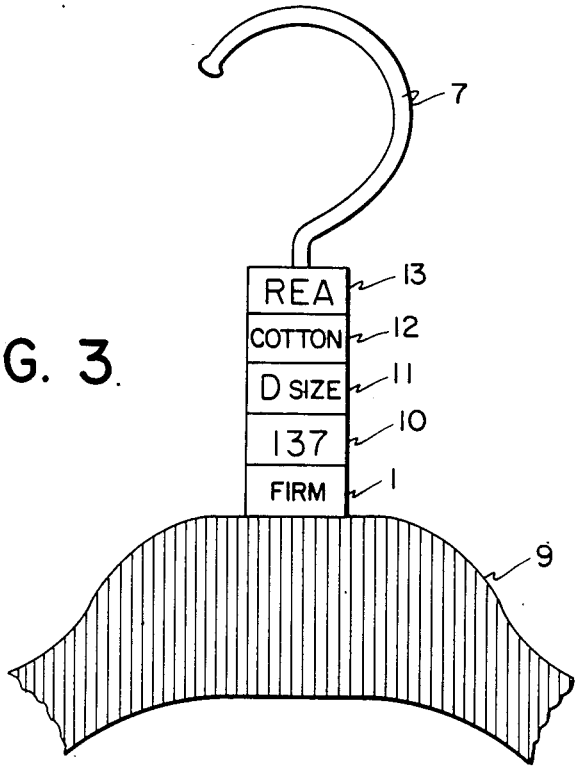

CLOTHING DATA MARKER

BACKGROUND OF THE INVENTION

This invention relates to clothing data systems and more particlarly to a marker of ring form for fitting onto a hook of a clothes hanger or the like. Markers have been employed for the identification of garments and other articles suspended in warehouses and for sale in shops and department stores. Such markers are both cheap and simple but have certain inconveniences.

U.S. Pat. No. 3,898,754 issued to the applicant shows different types of such markers or size separators which are described in detail therein.

However, the markers, as shown in U.S. Pat. No. 3,898,754, may be pulled off or torn off the hook as the hook is forced through the radial slot due to the fact that the radial slot within the ring type marker has parallel or mainly parallel sidewalls. The markers may then be easily lost.

Another disadvantage in the prior markers is the high material consumption in their manufacture relative to the percentage of volume of the solid material within the outer contour of the marker. This means that the cost in the manufacture of the marker is relatively high.

It is an object of the present invention to avoid these disadvantages of the earlier known markers while providing additional advantages.

SUMMARY OF THE INVENTION

The present invention provides a marker of cylindrical ring form for ready fitting onto a hook of a clothes hanger in order to convey information concerning a garment hung from the clothes hanger. The marker comprises a cylindrical ring defining a central traversing hole which is adapted to receive a clothes hanger hook, the ring having an outer cylindrical surface bearing alphanumeric data for external viewing, a radial slot within the cylindrical ring wall extending over the entire longitudinal extent of the wall, the slot having a width in excess of the width of the clothes hanger hook received internally thereof through the slot. The improvement comprises a pair of barbs arranged respectively to the sides of the slot on the inner surface of the cylindrical ring wall, the barbs having pointed wedged ends directed inwardly towards the center of the ring, and having surfaces converging towards each other to form a passage for the clothes hanger hook which is narrower than the width of the hook. As a result, the clothes hanger hook may be pushed through the slot and the passage defined by the pointed wedged ends of the barbs to readily permit entry of the clothes hanger hook, but prevent its removal through the slot. The axial longituinal length of the barbs may be less than the total length of the cylindrical ring. A plurality of radially projecting locating lugs may extend from the inner surface of the ring wall towards the center of the marker unit at circumferentially spaced positions about the inner periphery of the ring and to the sides of the barbs. The barbs and lugs may have a length of about thirty percent of the total length of the cylindrical ring. The pointed wedged ends of the barbs may resiliently abut each other.

Thus, according to the invention, information carrying units or tallies, for example, in the form of rings are provided with alphanumeric data or information on the peripheries thereof and are attached to the devices, for example, clothes hangers or clothes pegs which directly carry the garment. It is generally best to fit units to the hooks with which the clothes carrying devices are suspended on clothes rails or the like, and each individual unit should contain only a limited quantity of information. The present invention has a number of advantages, some of the more important of which are set out below. Thus, it gives a clear and uniform identification of each individual garment and reduces the risk of confusion of garments and of uncertainty on the part of customers and shop assistants. The markers save time for both parties, and the markers can be seen from all directions. The invention thereby offers a cheap marker since the cost of the marker material is low, the amount of material is substantially reduced over that of my prior U.S. Pat. No. 3,878,754. Further, the marker has a locking device which makes it impossible to remove the marker from the hook, except by use of excessive force, thus securely affixing the marker to the hook with connection thereto readily effected.

This invention will now be described in greater detail with reference to the attached drawings.

BRIEF DESCRIPTION OF THE DRAWINGS

FIG. 1 is a top plan view of a clothing data marker forming a preferred embodiment of the invention and constituting a ring with an adaptor slot and supporting lugs in accordance with the invention.

FIG. 2 is a sectional view of the marker of FIG. 1 taken about lines II—II.

FIG. 3 is a vertical elevational view of a portion of a hanger, the hook of which bears a number of markers of the form shown in FIGS. 1 and 2.

DESCRIPTION OF THE PREFERRED EMBODIMENT

FIG. 1 shows a marker, indicated generally at 1, in the form of a circular wall 2 defining an outer vertical side surface 3 intended and adapted to carry alphanumeric data or information as seen in FIG. 3. The marker ring wall is provided with a vertical slot 4 which traverses the full vertical height of wall 2. The width of slot 4 is in excess of the diameter or width of hook 7 which is shown in FIG. 1 as being centered therein after passage therethrough. A pair of inwardly directed, converging wedge-shaped barbs 5 are integrally formed or otherwise affixed to the inner periphery of ring wall 2 with the wedges to respective sides of slot 2 with the wedge-shaped edges or ends 6 of the barbs being pressed in contact with each other or situated very close to each other to define a narrow passage for the hook 7 which is significantly smaller than the diameter of the hook 7. However, at least the converging barbs are formed of a resilient material such that the barbs can be deflected laterally, permitting the hanger to be pressed through the slot 4 and pushed past the barbs 5 into the interior of the marker 1. The ring wall 2 on its inner periphery has a plurality of radially projecting lugs 8 which are circumferentially spaced about the inner periphery of the ring wall 2 and spaced from the barbs 5 at slot 4. The hook 7 upon entering the interior of the marker ring abuts the lug 8 which may be of different radial length, as may be seen in FIG. 1.

If one tries to take a marker 1 off of hook 7, the hook 7 will slip or slide along one of the side surfaces of the barbs 5, either to the right or left of the slot 4, and thus pressing the barbs 5 together. It will be virtually impossible to remove the marker from the hook, unless excessive force is used sufficient to deform the barbs 5 backwards and also to deform the marker ring wall 2. Preferably, the ring wall 2, the barbs 5 and the lugs 8 are integrally formed of a molded resilient plastic. When placing the marker 1 on the hook 7, the elasticity of wall 2 and of the barbs 5 will allow the barbs 5 to be displaced sidewise, that is, deflected laterally, thus enabling the marker 1 to be placed on the hook by pressing the marker laterally with the slot aligned with the side of hook 7, see FIG. 3.

FIG. 2 shows a section through the marker 1, and the wall 2, the abutting lug 8, and the barb 5 and hook 7 are clearly shown after passage of the hook 7 to the center of the ring marker. It should be noted that the axial length of barbs 5 and lugs 8 extends roughly one-third of the toyal axial length of the ring wall 2. This shows that the amount of material required for the barbs and lugs is considerably reduced in terms of that employed for the ring wall 2, as for instance by sixty percent.

FIG. 3 shows a series of markers as a 1, 10, 11, 12 and 13 placed in ascending order on the hook 7 of the clothes hanger 9. Marker 1 is attached by aligning its axis coaxial with the axis of hook 7 where it meets the body of the clothes hanger 9 with slot 4 facing the side of hook 7. By laterally pressing the marker against the hook 7, it will move through the slot deflecting the wedge shaped barbs 5 until the hook moves into the center of the marker 1 where it contacts lugs 8. The additional markers 10, 11, 12 and 13 are placed on the hook in the same fashion by pressing them laterally onto the hook as by finger presure. In like manner to U.S. Pat. No. 3,898,754, marker 1 may bear on its periphery information concerning the trademark as represented by the word FIRM. Marker 10 shows numeric information related to clothing article size. Marker 11 provides size variant data. Marker 12 provides fiber type data, i. e. COTTON, while marker 13 may bear special sales information represented by letters REA. As appreciated, various types of data may be provided in alphanumeric form which may be visually read or machine read.

Although the information been described with reference to a preferred embodiment, it may be arbitrarily varied within the scope of the following claims.

What is claimed is:

1. A marker adapted to fit onto a hook of a clothes hanger to convey information concerning a garment hung from the clothes hanger, said marker comprising a thin cylindrical ring wall extending longitudinally in the direction of the hook and defining a central traversing hole adapted to receive said clothes hanger hook, the outer surface of said ring wall bearing said information, a radial slot opening within said wall extending over the entire longitudinal length thereof, said slot having a width allowing passage laterally of said hook through said slot for mounting of said marker to said clothes hanger hook, a pair of barbs extending radially inwardly from the inner periphery of said ring wall and positioned to respective sides of said slot and having pointed, wedged ends directed inwardly towards the center of the ring, and having opposed surfaces converging towards each other to form a converging passage having at its inner end a width less than the diameter of said clothes hanger hook, and wherein at least said pair of barbs is formed of a resilient material, such that the clothes hanger hook in pushing through said slot and said passage, deflects the barbs away from each other to permit entry of the hook into the center of the cylindrical ring but said barbs prevent said hanger hook from exiting the slot absent deformation or destruction of at least one of said barbs, and wherein said marker further comprises a plurality of hook locating lugs extending from the inner periphery of the ring wall towards the center of the cylindrical ring wall, at circumferentially spaced positions and to respective sides of said pair of barbs, such that said lugs act jointly with said pair of barbs to center said cylindrical ring wall on said clothes hanger hook.

2. The marker as claimed in claim 1, wherein said cylindrical ring wall, said barbs and said lugs are of resilient material.

3. The marker as claimed in claim 1, wherein the axial longitudinal length of said barbs is less than the axial length of said cylindrical ring wall.

4. The marker as claimed in claim 3, wherein said barbs and said lugs each have a length of about thirty percent of the total length of said cylindrical ring wall.

5. The marker as claimed in claim 1, wherein the inner, radial ends of said barbs resiliently abut each other.

* * * * *